US007094034B2

(12) United States Patent
Fukuda et al.

(10) Patent No.: US 7,094,034 B2
(45) Date of Patent: Aug. 22, 2006

(54) AIRFOIL PROFILE WITH OPTIMIZED AERODYNAMIC SHAPE

(75) Inventors: Takao Fukuda, East Hartford, CT (US); Francis R. Price, Glastonbury, CT (US); Shankar S. Magge, South Windsor, CT (US)

(73) Assignee: United Technologies Corporation, Hartford, CT (US)

( * ) Notice: Subject to any disclaimer, the term of this patent is extended or adjusted under 35 U.S.C. 154(b) by 174 days.

(21) Appl. No.: 10/903,803

(22) Filed: Jul. 30, 2004

(65) Prior Publication Data

US 2006/0024168 A1 Feb. 2, 2006

(51) Int. Cl.
*F01D 5/14* (2006.01)

(52) U.S. Cl. ..... 416/223 A; 416/DIG. 2; 416/DIG. 5

(58) Field of Classification Search ..... 416/223 A, 416/223 R, 243, 241 R; 415/191, 192, 208.1, 415/208.2

See application file for complete search history.

(56) References Cited

U.S. PATENT DOCUMENTS 5,267,834 A * 12/1993 Dinh et al. ..... 416/DIG. 2
5,299,915 A * 4/1994 Dinh et al. ..... 416/DIG. 2
5,980,209 A * 11/1999 Barry et al. ..... 416/DIG. 5
6,398,489 B1 6/2002 Burdgick et al. ..... 415/115
6,450,770 B1 9/2002 Wang et al. ..... 416/223 A
6,503,054 B1 * 1/2003 Bielek et al. ..... 415/191
6,558,122 B1 * 5/2003 Xu et al. ..... 416/223 A
6,722,853 B1 4/2004 Humanchuk et al. ..... 416/223

* cited by examiner

*Primary Examiner*—Edward K. Look
*Assistant Examiner*—Igor Kershteyn
(74) *Attorney, Agent, or Firm*—Colin L. Cini

(57) ABSTRACT

Provided is an aerodynamic profile for use in gas turbine airfoil and a turbine blade comprising such profiles. The profiles counteract a reduction in area between adjacent airfoils due to an increase in coating thickness. A plurality of radial sections forms both coated and uncoated nominal profiles of the airfoils. The sections are located within a tolerance measured in any direction perpendicular to an airfoil stacking line extending radially from a central axis and defined by X, Y, and R Cartesian coordinate values in inches. The R values are measured perpendicular to a plane normal to the airfoil stacking line with R values of zero at a lowermost radial section and increasing in the radial direction. The X and Y values are measured perpendicular to the airfoil stacking line.

8 Claims, 2 Drawing Sheets

AIRFOIL PROFILE WITH OPTIMIZED AERODYNAMIC SHAPE

CROSS-REFERENCE TO RELATED APPLICATIONS

This application discloses subject matter related to co-pending US applications "COOLED ROTOR BLADE" Ser. No. 10/855,188, "COOLED ROTOR BLADE" Ser. No. 10/855,049, "COOLED ROTOR BLADE AND METHOD FOR COOLING A ROTOR BLADE" Ser. No. 10/855,010. "COOLED ROTOR BLADE WITH LEADING EDGE IMPINGEMENT COOLING" Ser. No. 10/855,064, "COOLED ROTOR BLADE" Ser. No. 10/855,149, "COOLED ROTOR BLADE" Ser. No. 10/885,183. The disclosures of which are incorporated herein by reference.

BACKGROUND OF THE INVENTION (1) Field of the Invention

The invention relates to gas turbine engine components, and more particularly to an aerodynamic profile for an airfoil and a blade comprising an airfoil with such a profile.

(2) Description of the Related Art

The efficiency of a gas turbine engine is directly related to the individual efficiencies of the major sections included therein. The turbine section contains bladed rotors, which extract power from hot combustion gases and transfer the power to a compressor section via common shafting. The efficiency of an airfoil portion of the blades determines the quantity of power extracted and conversely, the quantity of power that is wasted due to inefficiencies. Since the cost of fuel is a very important business consideration for gas turbine operators, any improvement to the aerodynamic efficiency of the airfoils is extremely beneficial.

During operation, turbine blades are exposed to combustion gases with temperatures that may exceed their melting temperature and must be thermally protected to extend their durability and useable life. Typically, blades are cooled by internal air passages and insulated externally by thermal barrier coatings. Various examples of internal air passages may be seen in the references incorporated herein. Internal passages are designed to provide adequate cooling for the airfoil, while not limiting the structural strength of the entire blade. Thermal barrier coatings of the type described in U.S. Pat. No. 5,262,245 to Ulion, et al., are applied to the airfoils of the blade with a thickness that varies based on the location on the airfoil. Airfoil locations that are exposed to the hottest combustion gas temperatures require a thicker coating.

The addition of thicker coatings to an airfoil may negatively affect the aerodynamic efficiency of an airfoil and specifically, an airfoil's ability to direct an adequate volume of combustion gases rearward. By increasing an airfoil's coating thickness, the area between adjacent airfoils is decreased; therefore, reducing the aerodynamic efficiency and ability to discharge an adequate volume of combustion gases. What is needed is an airfoil profile that will accept an increased coating thickness while maintaining an adequate area between adjacent airfoils.

BRIEF SUMMARY OF THE INVENTION

In accordance with an embodiment of the present invention, there is provided an airfoil profile, preferably for a first stage turbine blade, that improves the aerodynamic efficiency of a turbine. The profile also improves the first blade's interaction with a first and second stage vane for improved aerodynamic performance and reduced airfoil losses. Further, the profile allows for an increased coating thickness, without reducing the area between adjacent airfoils and the volume of combustion gas that may be directed rearward. The area between coated airfoils is maintained by rotating each airfoil to increase the area, thus counteracting the area lost by the increased coating thickness. In addition, the airfoil profile eliminates sources of performance penalties such as flow separation, separation bubbles, shock waves, leading edge overspeed and increased surface velocities.

An embodiment of the profile is defined by a plurality of two-dimensional sections disposed normal to a central, airfoil stacking line coincident with a radius extending from an engine centerline. Each section is defined by a plurality of X, Y Cartesian coordinate pairs disposed at a constant radial coordinate R, measured in inches from a platform high point. The X, Y, R coordinates for each section of the profile are provided at room temperature for nominal, uncoated airfoils in inches in Table 1. To account for variations in standard manufacturing processes, a coordinate tolerance of −0.006 inch to +0.006 inch, measured in any direction normal to the stacking line, defines an envelope containing the nominal coordinates of each section. To account for a coated profile, an additional coordinate tolerance of +0.002 inch to +0.014 inch (on top of the manufacturing tolerance), measured in any direction normal to the stacking line, defines an envelope containing the coated coordinates of each section. To define the two dimensional shape of each section, the X, Y coordinate pairs are smoothly faired with a spline. To complete the three dimensional profile, each of the two dimensional sections are smoothly joined together in the radial direction with a spline.

A gas turbine blade in accordance with an embodiment of the present invention improves the aerodynamic efficiency of a turbine, and the area between coated airfoils is maintained by rotating each airfoil, thus counteracting the area lost by the increased coating thickness. The blade comprises a nominal airfoil profile in accordance with the coordinates of Table 1 and may be uncoated or coated to suit a specific turbine application.

DETAILED DESCRIPTION OF THE INVENTION

Figure 1:
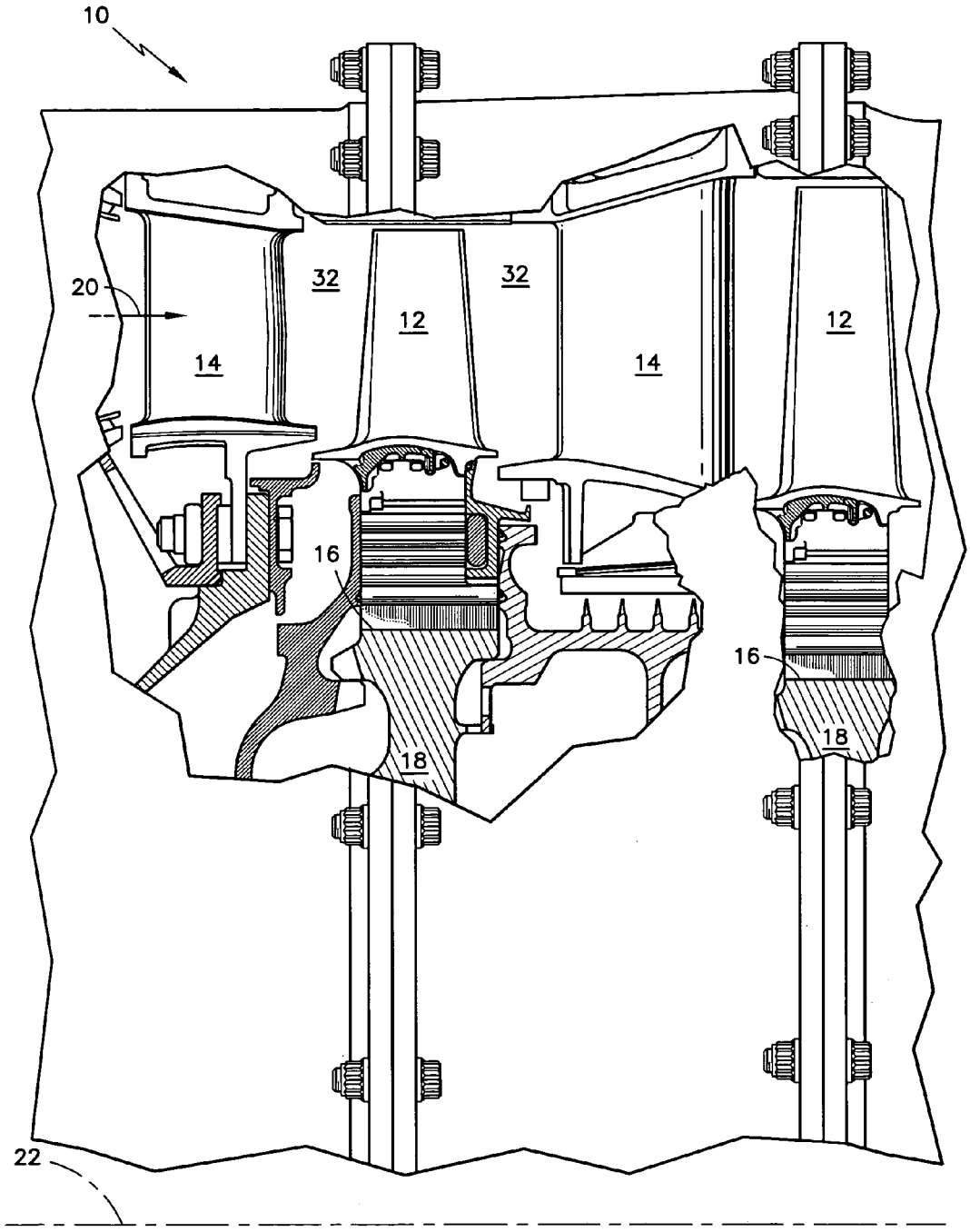
FIG. 1 is a partial schematic of a turbine section of a gas turbine engine.

A high-pressure turbine 10 of FIG. 1 includes alternating stages of rotating blades 12 and stationary vanes 14. The blades 12 of each stage are circumferentially disposed about a radially outer rim 16 of a disk 18. The blades 12 may be integrally formed with the disk 18 or may fit within spaced, fir tree slots directed axially through the thickness of the rim 16. The blades 12 extract power from combustion gases 20 and transfer the power to the disks 18, which rotate about a central axis 22 of the turbine 10. In order to protect the blades 12 from the hot combustion gases 20, internal cooling passages and thermal barrier coatings are typically utilized. Coating thickness is increased in the areas of the blades that are exposed to the combustion gases and have limited life. In the example shown, the blades 12 are disposed axially between the vanes 14 and interact aerodynamically therewith to provide optimum turbine 10 performance and efficiency. It is to be understood that the blades 12 may be alternately positioned in other turbine 10 configurations.

Figure 2:
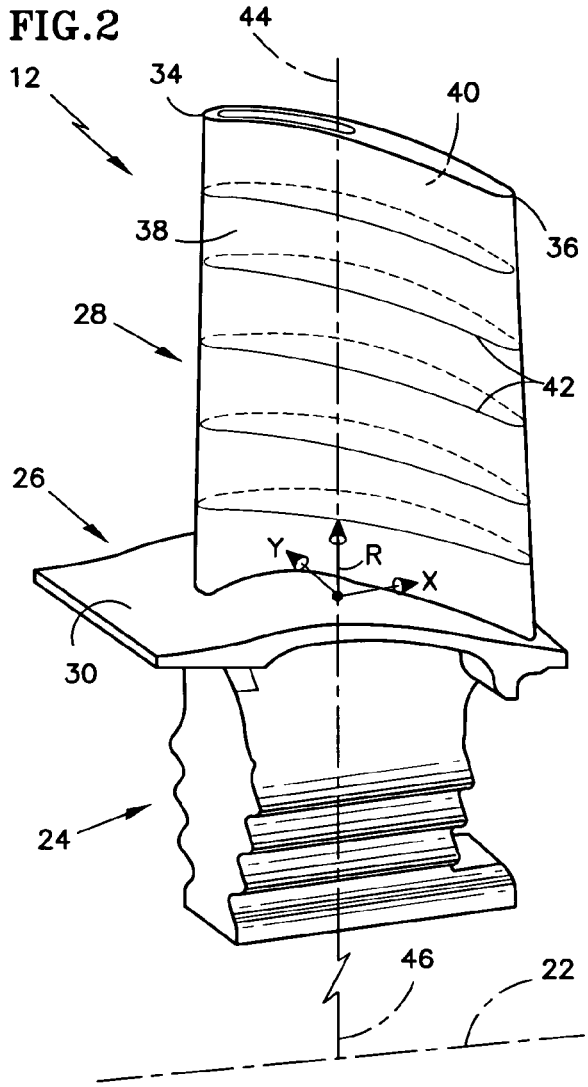
FIG. 2 is a perspective view of a first stage turbine blade in accordance with an embodiment of the present invention.
Figure 3:
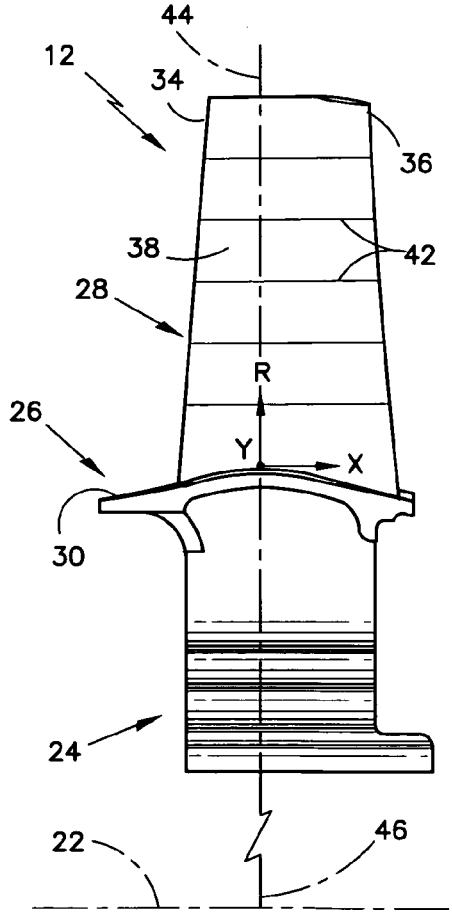
FIG. 3 is a side view of a first stage turbine blade in accordance with an embodiment of the present invention.

A turbine blade 12 comprising an airfoil profile in accordance with an embodiment of the present invention is shown in FIGS. 2 and 3. The blade 12 comprises a root 24, a platform 26 and an airfoil 28. An axial contour of the root 24 approximates a fir tree and fits within a slightly oversized slot in the disk 18, which has a similar contour. The root 24 is the innermost radial portion of the blade 12 and retains the blade 12 in the disk 18 during operation of the turbine 10. The platform 26 is a semi-annular surface between the root 24 and airfoil 28, forming an inner wall 30 of an annular duct 32 (FIG. 1) when mated with adjoining blades 12. The airfoil 28 is located radially outboard of the platform 26 and is the portion of the airfoil 28 which is exposed to the hot combustion gases. The airfoil 28 is staggered on the platform and forms an angle with the axially directed combustion gases 20. The area between adjacent blades 12 directs an adequate volume of the combustion gases 20 rearward to a following vane 14. By reducing the angle of the airfoil 28 in relation to the axially directed combustion gases 20, the area between adjacent airfoils 28 is increased, thus counteracting the area lost by the airfoil's 28 coating thickness.

The profile of the airfoil 28 in accordance with an embodiment of the present invention has a compound curvature and comprises a leading edge 34, a trailing edge 36, a pressure side 38 and a suction side 40. The profile is defined by a plurality of two-dimensional sections 42, each disposed in a plane normal to an airfoil stacking line 44. The airfoil stacking line 44 is coincident with a radius 46 extending radially outward from the central axis 22 of the turbine 10. Each section 42 is defined by a plurality of X, Y Cartesian coordinate pairs and a constant radial coordinate dimension R, measured in inches from a platform high point (shown as an axis origin in FIGS. 2 and 3). The radially innermost section 42 is defined at a zero radial coordinate dimension R, and each subsequent outer profile is defined at an increasing value of R. The X, Y coordinate pairs that define each section 42 are smoothly faired with a spline to complete each section 42. Similarly, each of the sections 42 are smoothly faired in the radial direction using a spline to complete the optimized profile of the airfoil 28.

The X, Y, R Cartesian coordinates defining a nominal, uncoated profile at room temperature are listed in inches in Table 1 below. As is shown in the table, each of the R coordinates defining a particular section 42 are constant, since each section 42 is defined at a constant radial distance from the central axis 22 of the turbine 10. The X and Y coordinates are listed with positive and negative Cartesian coordinate values measured perpendicular to the stacking line 44.

The coordinates listed in Table 1, define a nominal, uncoated profile of the airfoil 42 at room temperature and do not account for manufacturing tolerances, operating temperature or a variable coating thickness. Therefore, it is to be understood that a coordinate tolerance of −0.006 inch to +0.006 inch, measured in any direction perpendicular to the stacking line 44, defines an envelope containing the nominal coordinates of Table 1. To account for coatings on the airfoil 28, an additional coordinate tolerance of +0.002 inch to +0.014 inch, measured in any direction perpendicular to the stacking line 44, defines an envelope containing the coated coordinates of each section 42.

The X, Y and R coordinates may also be scaled up or down by multiplying each of the coordinates by a constant numerical value greater than zero. By scaling the coordinates of all the sections 42, a profile in accordance with an embodiment of the present invention may be used to optimize the performance of larger or smaller capacity turbines 10.

An uncoated gas turbine blade 12 in accordance with an embodiment of the present invention improves the aerodynamic efficiency of a turbine 10 and maintains the volume of combustion gases 20 directed rearward to a vane 14. An uncoated gas turbine airfoil 28 is coated with a thermal barrier coating prior to being installed in a gas turbine engine, and comprises a nominal profile in accordance with the coordinates of Table 1. To account for manufacturing tolerances, it is to be understood that a coordinate tolerance of −0.006 inch to +0.006 inch, measured in any direction perpendicular to the stacking line 44, defines an envelope containing the nominal coordinates of Table 1.

A coated gas turbine blade 12 in accordance with an embodiment of the present invention improves the aerodynamic efficiency of a turbine 10 and maintains the volume of combustion gases 20 directed rearward to a vane 14. The blade 12 comprises a nominal airfoil 28 profile in accordance with the coordinates of Table 1. To account for manufacturing tolerances and coating thickness, it is to be understood that a coordinate tolerance of between −0.004 and +0.020 measured in any direction perpendicular to the stacking line 44, defines an envelope containing the nominal coordinates of Table 1.

TABLE 1

TITLE: BLADE-HPT
SECTION TITLE: A-A
SECTION COORDINATES (X, Y, R)

| | | |
|---|---|---|
| −0.457245 | 0.122299 | 0.000000 |
| −0.458463 | 0.123713 | 0.000000 |
| −0.459634 | 0.125166 | 0.000000 |
| −0.461829 | 0.128185 | 0.000000 |
| −0.463824 | 0.131339 | 0.000000 |
| −0.466435 | 0.136297 | 0.000000 |
| −0.469198 | 0.143247 | 0.000000 |
| −0.471524 | 0.152316 | 0.000000 |
| −0.472843 | 0.165382 | 0.000000 |
| −0.471675 | 0.182268 | 0.000000 |
| −0.466746 | 0.202402 | 0.000000 |
| −0.457102 | 0.224984 | 0.000000 |
| −0.443072 | 0.249691 | 0.000000 |
| −0.425534 | 0.276742 | 0.000000 |
| −0.403899 | 0.305543 | 0.000000 |
| −0.377345 | 0.335204 | 0.000000 |
| −0.344969 | 0.364379 | 0.000000 |
| −0.305916 | 0.391135 | 0.000000 |
| −0.261458 | 0.412188 | 0.000000 |
| −0.210308 | 0.425837 | 0.000000 |
| −0.155601 | 0.429415 | 0.000000 |
| −0.101171 | 0.422651 | 0.000000 |
| −0.046843 | 0.406154 | 0.000000 |
| 0.004473 | 0.381764 | 0.000000 |
| 0.052377 | 0.351154 | 0.000000 |
| 0.096819 | 0.315670 | 0.000000 |
| 0.137926 | 0.276347 | 0.000000 |
| 0.175885 | 0.233957 | 0.000000 |
| 0.210891 | 0.189089 | 0.000000 |
| 0.243133 | 0.142188 | 0.000000 |
| 0.272829 | 0.093635 | 0.000000 |
| 0.300236 | 0.043757 | 0.000000 |
| 0.325620 | −0.007178 | 0.000000 |
| 0.349227 | −0.058952 | 0.000000 |
| 0.371287 | −0.111397 | 0.000000 |
| 0.392000 | −0.164374 | 0.000000 |
| 0.410896 | −0.215999 | 0.000000 |
| 0.428824 | −0.267948 | 0.000000 |
| 0.445319 | −0.318364 | 0.000000 |
| 0.459999 | −0.365363 | 0.000000 |
| 0.473594 | −0.410695 | 0.000000 |
| 0.485694 | −0.452504 | 0.000000 |

TABLE 1-continued

| | | |
|---|---|---|
| 0.496429 | −0.490749 | 0.000000 |
| 0.505904 | −0.525405 | 0.000000 |
| 0.514203 | −0.556450 | 0.000000 |
| 0.521394 | −0.583867 | 0.000000 |
| 0.527532 | −0.607645 | 0.000000 |
| 0.532662 | −0.627779 | 0.000000 |
| 0.536814 | −0.644254 | 0.000000 |
| 0.540019 | −0.657079 | 0.000000 |
| 0.541966 | −0.666175 | 0.000000 |
| 0.541698 | −0.673312 | 0.000000 |
| 0.539554 | −0.678190 | 0.000000 |
| 0.537303 | −0.680973 | 0.000000 |
| 0.534508 | −0.683216 | 0.000000 |
| 0.532948 | −0.684101 | 0.000000 |
| 0.531304 | −0.684818 | 0.000000 |
| 0.530097 | −0.685215 | 0.000000 |
| 0.528865 | −0.685522 | 0.000000 |
| 0.526349 | −0.685851 | 0.000000 |
| 0.523819 | −0.685794 | 0.000000 |
| 0.520116 | −0.684999 | 0.000000 |
| 0.515667 | −0.682687 | 0.000000 |
| 0.511395 | −0.678063 | 0.000000 |
| 0.506926 | −0.670017 | 0.000000 |
| 0.501415 | −0.659301 | 0.000000 |
| 0.494568 | −0.646273 | 0.000000 |
| 0.486314 | −0.630957 | 0.000000 |
| 0.476588 | −0.613389 | 0.000000 |
| 0.465308 | −0.593616 | 0.000000 |
| 0.452390 | −0.571685 | 0.000000 |
| 0.437745 | −0.547657 | 0.000000 |
| 0.421277 | −0.521595 | 0.000000 |
| 0.402887 | −0.493567 | 0.000000 |
| 0.383242 | −0.464748 | 0.000000 |
| 0.361524 | −0.434092 | 0.000000 |
| 0.338434 | −0.402751 | 0.000000 |
| 0.314756 | −0.371840 | 0.000000 |
| 0.289652 | −0.340322 | 0.000000 |
| 0.263940 | −0.309285 | 0.000000 |
| 0.237636 | −0.278739 | 0.000000 |
| 0.210736 | −0.248703 | 0.000000 |
| 0.183230 | −0.219208 | 0.000000 |
| 0.155117 | −0.190283 | 0.000000 |
| 0.126387 | −0.161957 | 0.000000 |
| 0.097027 | −0.134273 | 0.000000 |
| 0.067025 | −0.107279 | 0.000000 |
| 0.036353 | −0.081031 | 0.000000 |
| 0.004992 | −0.055606 | 0.000000 |
| −0.027096 | −0.031092 | 0.000000 |
| −0.059948 | −0.007601 | 0.000000 |
| −0.093612 | 0.014721 | 0.000000 |
| −0.126982 | 0.035009 | 0.000000 |
| −0.161229 | 0.053799 | 0.000000 |
| −0.195190 | 0.070223 | 0.000000 |
| −0.227566 | 0.083616 | 0.000000 |
| −0.259505 | 0.094380 | 0.000000 |
| −0.289598 | 0.101947 | 0.000000 |
| −0.317619 | 0.106316 | 0.000000 |
| −0.343283 | 0.107525 | 0.000000 |
| −0.366189 | 0.105687 | 0.000000 |
| −0.386049 | 0.102307 | 0.000000 |
| −0.403347 | 0.100963 | 0.000000 |
| −0.417947 | 0.102071 | 0.000000 |
| −0.429593 | 0.104799 | 0.000000 |
| −0.438237 | 0.108193 | 0.000000 |
| −0.444064 | 0.111337 | 0.000000 |
| −0.448460 | 0.114291 | 0.000000 |
| −0.451572 | 0.116755 | 0.000000 |
| −0.453548 | 0.118515 | 0.000000 |
| −0.455441 | 0.120365 | 0.000000 |
| −0.456355 | 0.121320 | 0.000000 |
| SECTION NUMBER: 2 | | |
| SECTION TITLE: B-B | | |
| SECTION COORDINATES (X, Y, R) | | |
| −0.447814 | 0.137404 | 0.178700 |
| −0.449034 | 0.138801 | 0.178700 |
| −0.450207 | 0.140236 | 0.178700 |
| −0.452413 | 0.143218 | 0.178700 |
| −0.454422 | 0.146336 | 0.178700 |

TABLE 1-continued

| | | |
|---|---|---|
| −0.457059 | 0.151239 | 0.178700 |
| −0.459869 | 0.158120 | 0.178700 |
| −0.462270 | 0.167108 | 0.178700 |
| −0.463718 | 0.180077 | 0.178700 |
| −0.462740 | 0.196870 | 0.178700 |
| −0.458067 | 0.216930 | 0.178700 |
| −0.448751 | 0.239506 | 0.178700 |
| −0.435713 | 0.264594 | 0.178700 |
| −0.419225 | 0.292080 | 0.178700 |
| −0.398521 | 0.321296 | 0.178700 |
| −0.372699 | 0.351274 | 0.178700 |
| −0.340774 | 0.380541 | 0.178700 |
| −0.301857 | 0.406974 | 0.178700 |
| −0.257318 | 0.427134 | 0.178700 |
| −0.206100 | 0.439213 | 0.178700 |
| −0.151630 | 0.440778 | 0.178700 |
| −0.097839 | 0.432012 | 0.178700 |
| −0.044469 | 0.413756 | 0.178700 |
| 0.005752 | 0.388014 | 0.178700 |
| 0.052538 | 0.356409 | 0.178700 |
| 0.095887 | 0.320199 | 0.178700 |
| 0.135924 | 0.280329 | 0.178700 |
| 0.172812 | 0.237510 | 0.178700 |
| 0.206711 | 0.192274 | 0.178700 |
| 0.237786 | 0.145048 | 0.178700 |
| 0.266265 | 0.096205 | 0.178700 |
| 0.292420 | 0.046076 | 0.178700 |
| 0.316542 | −0.005065 | 0.178700 |
| 0.338903 | −0.056993 | 0.178700 |
| 0.359754 | −0.109544 | 0.178700 |
| 0.379310 | −0.162579 | 0.178700 |
| 0.397155 | −0.214215 | 0.178700 |
| 0.414104 | −0.266135 | 0.178700 |
| 0.429725 | −0.316487 | 0.178700 |
| 0.443660 | −0.363401 | 0.178700 |
| 0.456597 | −0.408626 | 0.178700 |
| 0.468143 | −0.450320 | 0.178700 |
| 0.478415 | −0.488447 | 0.178700 |
| 0.487502 | −0.522986 | 0.178700 |
| 0.495483 | −0.553920 | 0.178700 |
| 0.502408 | −0.581232 | 0.178700 |
| 0.508331 | −0.604917 | 0.178700 |
| 0.513289 | −0.624970 | 0.178700 |
| 0.517304 | −0.641376 | 0.178700 |
| 0.520410 | −0.654155 | 0.178700 |
| 0.522658 | −0.663228 | 0.178700 |
| 0.523296 | −0.670395 | 0.178700 |
| 0.521593 | −0.675383 | 0.178700 |
| 0.519518 | −0.678250 | 0.178700 |
| 0.516824 | −0.680541 | 0.178700 |
| 0.515295 | −0.681431 | 0.178700 |
| 0.513672 | −0.682135 | 0.178700 |
| 0.512475 | −0.682510 | 0.178700 |
| 0.511253 | −0.682789 | 0.178700 |
| 0.508757 | −0.683026 | 0.178700 |
| 0.506259 | −0.682840 | 0.178700 |
| 0.502653 | −0.681777 | 0.178700 |
| 0.498507 | −0.679031 | 0.178700 |
| 0.494904 | −0.673782 | 0.178700 |
| 0.490863 | −0.665423 | 0.178700 |
| 0.485506 | −0.654680 | 0.178700 |
| 0.478860 | −0.641634 | 0.178700 |
| 0.470850 | −0.626280 | 0.178700 |
| 0.461410 | −0.608668 | 0.178700 |
| 0.450466 | −0.588837 | 0.178700 |
| 0.437938 | −0.566833 | 0.178700 |
| 0.423749 | −0.542705 | 0.178700 |
| 0.407818 | −0.516504 | 0.178700 |
| 0.390057 | −0.488290 | 0.178700 |
| 0.371101 | −0.459246 | 0.178700 |
| 0.350152 | −0.428314 | 0.178700 |
| 0.327877 | −0.396657 | 0.178700 |
| 0.305032 | −0.365395 | 0.178700 |
| 0.280819 | −0.333471 | 0.178700 |
| 0.256021 | −0.301985 | 0.178700 |
| 0.230635 | −0.270953 | 0.178700 |
| 0.204671 | −0.240389 | 0.178700 |
| 0.178130 | −0.210310 | 0.178700 |
| 0.151013 | −0.180740 | 0.178700 |

TABLE 1-continued

| | | |
|---|---|---|
| 0.123307 | −0.151709 | 0.178700 |
| 0.094997 | −0.123255 | 0.178700 |
| 0.066066 | −0.095425 | 0.178700 |
| 0.036484 | −0.068276 | 0.178700 |
| 0.006222 | −0.041876 | 0.178700 |
| −0.024762 | −0.016324 | 0.178700 |
| −0.056522 | 0.008269 | 0.178700 |
| −0.089119 | 0.031751 | 0.178700 |
| −0.121507 | 0.053193 | 0.178700 |
| −0.154846 | 0.073137 | 0.178700 |
| −0.188048 | 0.090618 | 0.178700 |
| −0.219870 | 0.104842 | 0.178700 |
| −0.251460 | 0.116104 | 0.178700 |
| −0.281412 | 0.123624 | 0.178700 |
| −0.309407 | 0.127207 | 0.178700 |
| −0.334994 | 0.126744 | 0.178700 |
| −0.357469 | 0.122437 | 0.178700 |
| −0.376939 | 0.117860 | 0.178700 |
| −0.394104 | 0.116459 | 0.178700 |
| −0.408630 | 0.117503 | 0.178700 |
| −0.420217 | 0.120163 | 0.178700 |
| −0.428827 | 0.123495 | 0.178700 |
| −0.434638 | 0.126590 | 0.178700 |
| −0.439025 | 0.129501 | 0.178700 |
| −0.442135 | 0.131932 | 0.178700 |
| −0.444111 | 0.133669 | 0.178700 |
| −0.446005 | 0.135495 | 0.178700 |
| −0.446920 | 0.136438 | 0.178700 |

SECTION NUMBER: 3
SECTION TITLE: C-C
SECTION COORDINATES (X, Y, R)

| | | |
|---|---|---|
| −0.436992 | 0.154589 | 0.357400 |
| −0.438184 | 0.155996 | 0.357400 |
| −0.439330 | 0.157440 | 0.357400 |
| −0.441479 | 0.160436 | 0.357400 |
| −0.443434 | 0.163564 | 0.357400 |
| −0.445993 | 0.168474 | 0.357400 |
| −0.448696 | 0.175350 | 0.357400 |
| −0.450975 | 0.184317 | 0.357400 |
| −0.452260 | 0.197231 | 0.357400 |
| −0.451100 | 0.213921 | 0.357400 |
| −0.446229 | 0.233816 | 0.357400 |
| −0.436744 | 0.256181 | 0.357400 |
| −0.423679 | 0.281086 | 0.357400 |
| −0.407278 | 0.308425 | 0.357400 |
| −0.386807 | 0.337576 | 0.357400 |
| −0.361370 | 0.367608 | 0.357400 |
| −0.329951 | 0.397079 | 0.357400 |
| −0.291554 | 0.423811 | 0.357400 |
| −0.247408 | 0.444148 | 0.357400 |
| −0.196452 | 0.455920 | 0.357400 |
| −0.142315 | 0.456394 | 0.357400 |
| −0.089206 | 0.445869 | 0.357400 |
| −0.037025 | 0.425434 | 0.357400 |
| 0.011587 | 0.397489 | 0.357400 |
| 0.056492 | 0.363854 | 0.357400 |
| 0.097831 | 0.325883 | 0.357400 |
| 0.135842 | 0.284548 | 0.357400 |
| 0.170767 | 0.240555 | 0.357400 |
| 0.202831 | 0.194418 | 0.357400 |
| 0.232264 | 0.146548 | 0.357400 |
| 0.259329 | 0.097291 | 0.357400 |
| 0.284302 | 0.046932 | 0.357400 |
| 0.307444 | −0.004297 | 0.357400 |
| 0.328995 | −0.056215 | 0.357400 |
| 0.349164 | −0.108682 | 0.357400 |
| 0.368135 | −0.161588 | 0.357400 |
| 0.385480 | −0.213064 | 0.357400 |
| 0.401973 | −0.264809 | 0.357400 |
| 0.417181 | −0.314975 | 0.357400 |
| 0.430742 | −0.361710 | 0.357400 |
| 0.443330 | −0.406759 | 0.357400 |
| 0.454549 | −0.448288 | 0.357400 |
| 0.464519 | −0.486262 | 0.357400 |
| 0.473330 | −0.520661 | 0.357400 |
| 0.481054 | −0.551470 | 0.357400 |
| 0.487752 | −0.578670 | 0.357400 |
| 0.493472 | −0.602259 | 0.357400 |

TABLE 1-continued

| | | |
|---|---|---|
| 0.498253 | −0.622229 | 0.357400 |
| 0.502123 | −0.638567 | 0.357400 |
| 0.505115 | −0.651298 | 0.357400 |
| 0.507232 | −0.660326 | 0.357400 |
| 0.507636 | −0.667438 | 0.357400 |
| 0.505817 | −0.672350 | 0.357400 |
| 0.503697 | −0.675159 | 0.357400 |
| 0.500986 | −0.677395 | 0.357400 |
| 0.499455 | −0.678264 | 0.357400 |
| 0.497833 | −0.678946 | 0.357400 |
| 0.496635 | −0.679315 | 0.357400 |
| 0.495412 | −0.679585 | 0.357400 |
| 0.492916 | −0.679812 | 0.357400 |
| 0.490422 | −0.679622 | 0.357400 |
| 0.486822 | −0.678562 | 0.357400 |
| 0.482658 | −0.675853 | 0.357400 |
| 0.479016 | −0.670661 | 0.357400 |
| 0.474978 | −0.662347 | 0.357400 |
| 0.469699 | −0.651587 | 0.357400 |
| 0.463190 | −0.638482 | 0.357400 |
| 0.455402 | −0.623036 | 0.357400 |
| 0.446288 | −0.605280 | 0.357400 |
| 0.435783 | −0.585241 | 0.357400 |
| 0.423824 | −0.562961 | 0.357400 |
| 0.410329 | −0.538478 | 0.357400 |
| 0.395222 | −0.511839 | 0.357400 |
| 0.378418 | −0.483101 | 0.357400 |
| 0.360522 | −0.453455 | 0.357400 |
| 0.340774 | −0.421812 | 0.357400 |
| 0.319793 | −0.389362 | 0.357400 |
| 0.298274 | −0.357253 | 0.357400 |
| 0.275452 | −0.324411 | 0.357400 |
| 0.252049 | −0.291967 | 0.357400 |
| 0.228055 | −0.259944 | 0.357400 |
| 0.203462 | −0.228364 | 0.357400 |
| 0.178269 | −0.197246 | 0.357400 |
| 0.152462 | −0.166623 | 0.357400 |
| 0.126026 | −0.136531 | 0.357400 |
| 0.098935 | −0.107017 | 0.357400 |
| 0.071160 | −0.078134 | 0.357400 |
| 0.042663 | −0.049951 | 0.357400 |
| 0.013403 | −0.022553 | 0.357400 |
| −0.016679 | 0.003949 | 0.357400 |
| −0.047650 | 0.029417 | 0.357400 |
| −0.079596 | 0.053660 | 0.357400 |
| −0.111504 | 0.075695 | 0.357400 |
| −0.144534 | 0.096023 | 0.357400 |
| −0.177620 | 0.113592 | 0.357400 |
| −0.209506 | 0.127544 | 0.357400 |
| −0.241294 | 0.138087 | 0.357400 |
| −0.271483 | 0.144415 | 0.357400 |
| −0.299606 | 0.146370 | 0.357400 |
| −0.325065 | 0.144030 | 0.357400 |
| −0.347081 | 0.138198 | 0.357400 |
| −0.366539 | 0.133987 | 0.357400 |
| −0.383706 | 0.132856 | 0.357400 |
| −0.398184 | 0.134126 | 0.357400 |
| −0.409710 | 0.136961 | 0.357400 |
| −0.418248 | 0.140420 | 0.357400 |
| −0.424004 | 0.143599 | 0.357400 |
| −0.428338 | 0.146569 | 0.357400 |
| −0.431404 | 0.149041 | 0.357400 |
| −0.433350 | 0.150805 | 0.357400 |
| −0.435214 | 0.152655 | 0.357400 |
| −0.436115 | 0.153613 | 0.357400 |

SECTION NUMBER: 4
SECTION TITLE: D-D
SECTION COORDINATES (X, Y, R)

| | | |
|---|---|---|
| −0.426656 | 0.178410 | 0.536101 |
| −0.427800 | 0.179831 | 0.536101 |
| −0.428899 | 0.181285 | 0.536101 |
| −0.430952 | 0.184297 | 0.536101 |
| −0.432812 | 0.187438 | 0.536101 |
| −0.435229 | 0.192351 | 0.536101 |
| −0.437752 | 0.199208 | 0.536101 |
| −0.439817 | 0.208124 | 0.536101 |
| −0.440829 | 0.220920 | 0.536101 |
| −0.439357 | 0.237405 | 0.536101 |

TABLE 1-continued

| | | |
|---|---|---|
| −0.434160 | 0.256987 | 0.536101 |
| −0.424351 | 0.278913 | 0.536101 |
| −0.410741 | 0.303156 | 0.536101 |
| −0.393832 | 0.329762 | 0.536101 |
| −0.372920 | 0.358103 | 0.536101 |
| −0.347130 | 0.387243 | 0.536101 |
| −0.315450 | 0.415717 | 0.536101 |
| −0.276873 | 0.441248 | 0.536101 |
| −0.232646 | 0.460034 | 0.536101 |
| −0.181861 | 0.469664 | 0.536101 |
| −0.128405 | 0.467473 | 0.536101 |
| −0.076586 | 0.454154 | 0.536101 |
| −0.026260 | 0.431022 | 0.536101 |
| 0.020171 | 0.400751 | 0.536101 |
| 0.062749 | 0.365201 | 0.536101 |
| 0.101747 | 0.325714 | 0.536101 |
| 0.137488 | 0.283222 | 0.536101 |
| 0.170271 | 0.238385 | 0.536101 |
| 0.200372 | 0.191689 | 0.536101 |
| 0.228069 | 0.143510 | 0.536101 |
| 0.253635 | 0.094154 | 0.536101 |
| 0.277338 | 0.043873 | 0.536101 |
| 0.299403 | −0.007154 | 0.536101 |
| 0.320040 | −0.058779 | 0.536101 |
| 0.339425 | −0.110885 | 0.536101 |
| 0.357706 | −0.163386 | 0.536101 |
| 0.374445 | −0.214435 | 0.536101 |
| 0.390381 | −0.265735 | 0.536101 |
| 0.405078 | −0.315453 | 0.536101 |
| 0.418177 | −0.361766 | 0.536101 |
| 0.430325 | −0.406403 | 0.536101 |
| 0.441141 | −0.447549 | 0.536101 |
| 0.450738 | −0.485173 | 0.536101 |
| 0.459212 | −0.519250 | 0.536101 |
| 0.466629 | −0.549772 | 0.536101 |
| 0.473054 | −0.576718 | 0.536101 |
| 0.478534 | −0.600086 | 0.536101 |
| 0.483111 | −0.619863 | 0.536101 |
| 0.486813 | −0.636051 | 0.536101 |
| 0.489671 | −0.648662 | 0.536101 |
| 0.491662 | −0.657604 | 0.536101 |
| 0.491980 | −0.664642 | 0.536101 |
| 0.490124 | −0.669476 | 0.536101 |
| 0.488000 | −0.672233 | 0.536101 |
| 0.485301 | −0.674419 | 0.536101 |
| 0.483780 | −0.675266 | 0.536101 |
| 0.482173 | −0.675927 | 0.536101 |
| 0.480967 | −0.676287 | 0.536101 |
| 0.479737 | −0.676547 | 0.536101 |
| 0.477234 | −0.676748 | 0.536101 |
| 0.474750 | −0.676532 | 0.536101 |
| 0.471176 | −0.675425 | 0.536101 |
| 0.467023 | −0.672646 | 0.536101 |
| 0.463451 | −0.667332 | 0.536101 |
| 0.459086 | −0.659217 | 0.536101 |
| 0.453357 | −0.648661 | 0.536101 |
| 0.446389 | −0.635689 | 0.536101 |
| 0.438182 | −0.620405 | 0.536101 |
| 0.428764 | −0.602723 | 0.536101 |
| 0.418116 | −0.582662 | 0.536101 |
| 0.406203 | −0.560241 | 0.536101 |
| 0.392913 | −0.535511 | 0.536101 |
| 0.378096 | −0.508556 | 0.536101 |
| 0.361651 | −0.479436 | 0.536101 |
| 0.344247 | −0.449315 | 0.536101 |
| 0.325273 | −0.417011 | 0.536101 |
| 0.305423 | −0.383667 | 0.536101 |
| 0.285294 | −0.350484 | 0.536101 |
| 0.264089 | −0.316388 | 0.536101 |
| 0.242508 | −0.282528 | 0.536101 |
| 0.220677 | −0.248849 | 0.536101 |
| 0.198421 | −0.215450 | 0.536101 |
| 0.175550 | −0.182456 | 0.536101 |
| 0.152023 | −0.149914 | 0.536101 |
| 0.127801 | −0.117870 | 0.536101 |
| 0.102831 | −0.086393 | 0.536101 |
| 0.077053 | −0.055556 | 0.536101 |
| 0.050390 | −0.025456 | 0.536101 |
| 0.022761 | 0.003780 | 0.536101 |

TABLE 1-continued

| | | |
|---|---|---|
| −0.005940 | 0.031993 | 0.536101 |
| −0.035832 | 0.058968 | 0.536101 |
| −0.067067 | 0.084419 | 0.536101 |
| −0.098676 | 0.107208 | 0.536101 |
| −0.131827 | 0.127724 | 0.536101 |
| −0.165400 | 0.144760 | 0.536101 |
| −0.197975 | 0.157450 | 0.536101 |
| −0.230468 | 0.166053 | 0.536101 |
| −0.261142 | 0.170120 | 0.536101 |
| −0.289425 | 0.169967 | 0.536101 |
| −0.314803 | 0.166159 | 0.536101 |
| −0.336761 | 0.159906 | 0.536101 |
| −0.356384 | 0.156162 | 0.536101 |
| −0.373655 | 0.155382 | 0.536101 |
| −0.388167 | 0.156966 | 0.536101 |
| −0.399677 | 0.160067 | 0.536101 |
| −0.408176 | 0.163731 | 0.536101 |
| −0.413880 | 0.167054 | 0.536101 |
| −0.418164 | 0.170143 | 0.536101 |
| −0.421182 | 0.172698 | 0.536101 |
| −0.423094 | 0.174518 | 0.536101 |
| −0.424920 | 0.176423 | 0.536101 |
| −0.425800 | 0.177406 | 0.536101 |

SECTION NUMBER: 5
SECTION TITLE: E-E
SECTION COORDINATES (X, Y, R)

| | | |
|---|---|---|
| −0.416167 | 0.207431 | 0.714800 |
| −0.417258 | 0.208859 | 0.714800 |
| −0.418305 | 0.210319 | 0.714800 |
| −0.420257 | 0.213337 | 0.714800 |
| −0.422017 | 0.216474 | 0.714800 |
| −0.424292 | 0.221368 | 0.714800 |
| −0.426641 | 0.228178 | 0.714800 |
| −0.428506 | 0.237004 | 0.714800 |
| −0.429283 | 0.249633 | 0.714800 |
| −0.427564 | 0.265856 | 0.714800 |
| −0.422138 | 0.285078 | 0.714800 |
| −0.412117 | 0.306518 | 0.714800 |
| −0.397893 | 0.329932 | 0.714800 |
| −0.380277 | 0.355538 | 0.714800 |
| −0.358584 | 0.382638 | 0.714800 |
| −0.331939 | 0.410214 | 0.714800 |
| −0.299355 | 0.436656 | 0.714800 |
| −0.259935 | 0.459489 | 0.714800 |
| −0.215200 | 0.474884 | 0.714800 |
| −0.164601 | 0.480405 | 0.714800 |
| −0.112294 | 0.474001 | 0.714800 |
| −0.062388 | 0.457041 | 0.714800 |
| −0.014464 | 0.430962 | 0.714800 |
| 0.029446 | 0.398520 | 0.714800 |
| 0.069554 | 0.361428 | 0.714800 |
| 0.106207 | 0.320884 | 0.714800 |
| 0.139761 | 0.277702 | 0.714800 |
| 0.170526 | 0.232465 | 0.714800 |
| 0.198796 | 0.185608 | 0.714800 |
| 0.224862 | 0.137466 | 0.714800 |
| 0.248987 | 0.088307 | 0.714800 |
| 0.271418 | 0.038344 | 0.714800 |
| 0.292358 | −0.012270 | 0.714800 |
| 0.311991 | −0.063409 | 0.714800 |
| 0.330475 | −0.114977 | 0.714800 |
| 0.347941 | −0.166894 | 0.714800 |
| 0.363958 | −0.217348 | 0.714800 |
| 0.379222 | −0.268028 | 0.714800 |
| 0.393309 | −0.317131 | 0.714800 |
| 0.405874 | −0.362858 | 0.714800 |
| 0.417526 | −0.406921 | 0.714800 |
| 0.427901 | −0.447532 | 0.714800 |
| 0.437107 | −0.484663 | 0.714800 |
| 0.445231 | −0.518290 | 0.714800 |
| 0.452342 | −0.548405 | 0.714800 |
| 0.458501 | −0.574992 | 0.714800 |
| 0.463752 | −0.598044 | 0.714800 |
| 0.468137 | −0.617558 | 0.714800 |
| 0.471684 | −0.633523 | 0.714800 |
| 0.474419 | −0.645971 | 0.714800 |
| 0.476354 | −0.654769 | 0.714800 |
| 0.476476 | −0.661697 | 0.714800 |

TABLE 1-continued

| | | |
|---|---|---|
| 0.474547 | −0.666421 | 0.714800 |
| 0.472411 | −0.669099 | 0.714800 |
| 0.469723 | −0.671222 | 0.714800 |
| 0.468218 | −0.672039 | 0.714800 |
| 0.466630 | −0.672679 | 0.714800 |
| 0.465414 | −0.673034 | 0.714800 |
| 0.464175 | −0.673286 | 0.714800 |
| 0.461650 | −0.673471 | 0.714800 |
| 0.459137 | −0.673229 | 0.714800 |
| 0.455528 | −0.672079 | 0.714800 |
| 0.451409 | −0.669227 | 0.714800 |
| 0.447865 | −0.663845 | 0.714800 |
| 0.443438 | −0.655565 | 0.714800 |
| 0.437613 | −0.644966 | 0.714800 |
| 0.430491 | −0.632022 | 0.714800 |
| 0.422068 | −0.616727 | 0.714800 |
| 0.412367 | −0.599067 | 0.714800 |
| 0.401388 | −0.579039 | 0.714800 |
| 0.389142 | −0.556641 | 0.714800 |
| 0.375610 | −0.531875 | 0.714800 |
| 0.360759 | −0.504756 | 0.714800 |
| 0.344542 | −0.475311 | 0.714800 |
| 0.327609 | −0.444716 | 0.714800 |
| 0.309350 | −0.411774 | 0.714800 |
| 0.290453 | −0.377641 | 0.714800 |
| 0.271526 | −0.343511 | 0.714800 |
| 0.251863 | −0.308241 | 0.714800 |
| 0.232127 | −0.273006 | 0.714800 |
| 0.212381 | −0.237765 | 0.714800 |
| 0.192311 | −0.202691 | 0.714800 |
| 0.171635 | −0.167956 | 0.714800 |
| 0.150296 | −0.133611 | 0.714800 |
| 0.128229 | −0.099715 | 0.714800 |
| 0.105357 | −0.066343 | 0.714800 |
| 0.081588 | −0.033589 | 0.714800 |
| 0.056815 | −0.001571 | 0.714800 |
| 0.030911 | 0.029554 | 0.714800 |
| 0.003727 | 0.059585 | 0.714800 |
| −0.024913 | 0.088249 | 0.714800 |
| −0.055219 | 0.115176 | 0.714800 |
| −0.086299 | 0.139070 | 0.714800 |
| −0.119324 | 0.160229 | 0.714800 |
| −0.153159 | 0.177272 | 0.714800 |
| −0.186239 | 0.189287 | 0.714800 |
| −0.219297 | 0.196580 | 0.714800 |
| −0.250358 | 0.199037 | 0.714800 |
| −0.278766 | 0.197457 | 0.714800 |
| −0.304122 | 0.192867 | 0.714800 |
| −0.326237 | 0.186799 | 0.714800 |
| −0.346044 | 0.183421 | 0.714800 |
| −0.363425 | 0.183023 | 0.714800 |
| −0.377983 | 0.184944 | 0.714800 |
| −0.389483 | 0.188327 | 0.714800 |
| −0.397945 | 0.192211 | 0.714800 |
| −0.403600 | 0.195690 | 0.714800 |
| −0.407833 | 0.198904 | 0.714800 |
| −0.410805 | 0.201548 | 0.714800 |
| −0.412684 | 0.203426 | 0.714800 |
| −0.414471 | 0.205389 | 0.714800 |
| −0.415331 | 0.206400 | 0.714800 |
| SECTION NUMBER: 6 | | |
| SECTION TITLE: F-F | | |
| SECTION COORDINATES (X, Y, R) | | |
| −0.403918 | 0.240758 | 0.893500 |
| −0.404947 | 0.242198 | 0.893500 |
| −0.405932 | 0.243668 | 0.893500 |
| −0.407763 | 0.246700 | 0.893500 |
| −0.409402 | 0.249839 | 0.893500 |
| −0.411498 | 0.254724 | 0.893500 |
| −0.413616 | 0.261497 | 0.893500 |
| −0.415209 | 0.270239 | 0.893500 |
| −0.415629 | 0.282699 | 0.893500 |
| −0.413506 | 0.298630 | 0.893500 |
| −0.407659 | 0.317428 | 0.893500 |
| −0.397229 | 0.338282 | 0.893500 |
| −0.382341 | 0.360797 | 0.893500 |
| −0.363905 | 0.385253 | 0.893500 |
| −0.341275 | 0.410892 | 0.893500 |

TABLE 1-continued

| | | |
|---|---|---|
| −0.313578 | 0.436566 | 0.893500 |
| −0.279865 | 0.460447 | 0.893500 |
| −0.239410 | 0.479779 | 0.893500 |
| −0.194167 | 0.490730 | 0.893500 |
| −0.144106 | 0.490965 | 0.893500 |
| −0.093590 | 0.479424 | 0.893500 |
| −0.046267 | 0.458285 | 0.893500 |
| −0.001312 | 0.429006 | 0.893500 |
| 0.039676 | 0.394330 | 0.893500 |
| 0.077061 | 0.355748 | 0.893500 |
| 0.111248 | 0.314265 | 0.893500 |
| 0.142598 | 0.270556 | 0.893500 |
| 0.171424 | 0.225111 | 0.893500 |
| 0.198015 | 0.178293 | 0.893500 |
| 0.222642 | 0.130389 | 0.893500 |
| 0.245542 | 0.081617 | 0.893500 |
| 0.266922 | 0.032140 | 0.893500 |
| 0.286959 | −0.017906 | 0.893500 |
| 0.305809 | −0.068418 | 0.893500 |
| 0.323602 | −0.119314 | 0.893500 |
| 0.340452 | −0.170525 | 0.893500 |
| 0.355938 | −0.220281 | 0.893500 |
| 0.370711 | −0.270240 | 0.893500 |
| 0.384362 | −0.318639 | 0.893500 |
| 0.396545 | −0.363696 | 0.893500 |
| 0.407845 | −0.407115 | 0.893500 |
| 0.417907 | −0.447125 | 0.893500 |
| 0.426834 | −0.483703 | 0.893500 |
| 0.434706 | −0.516833 | 0.893500 |
| 0.441594 | −0.546493 | 0.893500 |
| 0.447555 | −0.572683 | 0.893500 |
| 0.452634 | −0.595388 | 0.893500 |
| 0.456872 | −0.614610 | 0.893500 |
| 0.460294 | −0.630329 | 0.893500 |
| 0.462950 | −0.642598 | 0.893500 |
| 0.464579 | −0.651195 | 0.893500 |
| 0.463596 | −0.657889 | 0.893500 |
| 0.461166 | −0.662337 | 0.893500 |
| 0.458853 | −0.664813 | 0.893500 |
| 0.456093 | −0.666782 | 0.893500 |
| 0.454582 | −0.667548 | 0.893500 |
| 0.453002 | −0.668162 | 0.893500 |
| 0.451773 | −0.668519 | 0.893500 |
| 0.450521 | −0.668781 | 0.893500 |
| 0.447971 | −0.669024 | 0.893500 |
| 0.445402 | −0.668873 | 0.893500 |
| 0.441661 | −0.667931 | 0.893500 |
| 0.437271 | −0.665426 | 0.893500 |
| 0.433095 | −0.660609 | 0.893500 |
| 0.428997 | −0.652100 | 0.893500 |
| 0.423649 | −0.641146 | 0.893500 |
| 0.417051 | −0.627932 | 0.893500 |
| 0.409156 | −0.612263 | 0.893500 |
| 0.399911 | −0.594277 | 0.893500 |
| 0.389300 | −0.573965 | 0.893500 |
| 0.377335 | −0.551320 | 0.893500 |
| 0.364090 | −0.526304 | 0.893500 |
| 0.349701 | −0.498842 | 0.893500 |
| 0.334211 | −0.468904 | 0.893500 |
| 0.318173 | −0.437722 | 0.893500 |
| 0.300871 | −0.404148 | 0.893500 |
| 0.282872 | −0.369408 | 0.893500 |
| 0.264845 | −0.334680 | 0.893500 |
| 0.246243 | −0.298722 | 0.893500 |
| 0.227666 | −0.262742 | 0.893500 |
| 0.208973 | −0.226811 | 0.893500 |
| 0.189965 | −0.191028 | 0.893500 |
| 0.170384 | −0.155542 | 0.893500 |
| 0.150150 | −0.120414 | 0.893500 |
| 0.129201 | −0.085698 | 0.893500 |
| 0.107459 | −0.051460 | 0.893500 |
| 0.084829 | −0.017789 | 0.893500 |
| 0.061206 | 0.015204 | 0.893500 |
| 0.036455 | 0.047371 | 0.893500 |
| 0.010417 | 0.078523 | 0.893500 |
| −0.017094 | 0.108394 | 0.893500 |
| −0.046302 | 0.136631 | 0.893500 |
| −0.076385 | 0.161898 | 0.893500 |
| −0.108514 | 0.184531 | 0.893500 |

TABLE 1-continued

| | | |
|---|---|---|
| −0.141644 | 0.203071 | 0.893500 |
| −0.174269 | 0.216475 | 0.893500 |
| −0.207108 | 0.225015 | 0.893500 |
| −0.238151 | 0.228439 | 0.893500 |
| −0.266657 | 0.227533 | 0.893500 |
| −0.292146 | 0.223390 | 0.893500 |
| −0.314417 | 0.217738 | 0.893500 |
| −0.334340 | 0.214832 | 0.893500 |
| −0.351764 | 0.214868 | 0.893500 |
| −0.366298 | 0.217161 | 0.893500 |
| −0.377735 | 0.220848 | 0.893500 |
| −0.386107 | 0.224973 | 0.893500 |
| −0.391679 | 0.228619 | 0.893500 |
| −0.395826 | 0.231957 | 0.893500 |
| −0.398728 | 0.234700 | 0.893500 |
| −0.400552 | 0.236637 | 0.893500 |
| −0.402283 | 0.238657 | 0.893500 |
| −0.403112 | 0.239698 | 0.893500 |

SECTION NUMBER: 7
SECTION TITLE: G-G
SECTION COORDINATES (X, Y, R)

| | | |
|---|---|---|
| −0.390883 | 0.285325 | 1.072200 |
| −0.391763 | 0.286821 | 1.072200 |
| −0.392597 | 0.288335 | 1.072200 |
| −0.394112 | 0.291449 | 1.072200 |
| −0.395426 | 0.294652 | 1.072200 |
| −0.397020 | 0.299600 | 1.072200 |
| −0.398451 | 0.306391 | 1.072200 |
| −0.399167 | 0.315055 | 1.072200 |
| −0.398358 | 0.327224 | 1.072200 |
| −0.394709 | 0.342523 | 1.072200 |
| −0.387125 | 0.360220 | 1.072200 |
| −0.374840 | 0.379443 | 1.072200 |
| −0.358206 | 0.399993 | 1.072200 |
| −0.337982 | 0.422230 | 1.072200 |
| −0.313480 | 0.445294 | 1.072200 |
| −0.283826 | 0.467748 | 1.072200 |
| −0.248257 | 0.487319 | 1.072200 |
| −0.206553 | 0.500841 | 1.072200 |
| −0.161424 | 0.504885 | 1.072200 |
| −0.113286 | 0.497719 | 1.072200 |
| −0.066233 | 0.479563 | 1.072200 |
| −0.023090 | 0.453288 | 1.072200 |
| 0.017418 | 0.420140 | 1.072200 |
| 0.054189 | 0.382794 | 1.072200 |
| 0.087765 | 0.342474 | 1.072200 |
| 0.118616 | 0.299972 | 1.072200 |
| 0.147125 | 0.255811 | 1.072200 |
| 0.173609 | 0.210361 | 1.072200 |
| 0.198314 | 0.163884 | 1.072200 |
| 0.221462 | 0.116578 | 1.072200 |
| 0.243222 | 0.068588 | 1.072200 |
| 0.263740 | 0.020033 | 1.072200 |
| 0.283136 | −0.028999 | 1.072200 |
| 0.301516 | −0.078433 | 1.072200 |
| 0.318973 | −0.128206 | 1.072200 |
| 0.335575 | −0.178268 | 1.072200 |
| 0.350883 | −0.226896 | 1.072200 |
| 0.365518 | −0.275717 | 1.072200 |
| 0.379056 | −0.323013 | 1.072200 |
| 0.391137 | −0.367050 | 1.072200 |
| 0.402334 | −0.409484 | 1.072200 |
| 0.412293 | −0.448591 | 1.072200 |
| 0.421113 | −0.484348 | 1.072200 |
| 0.428882 | −0.516735 | 1.072200 |
| 0.435665 | −0.545731 | 1.072200 |
| 0.441525 | −0.571335 | 1.072200 |
| 0.446507 | −0.593533 | 1.072200 |
| 0.450650 | −0.612334 | 1.072200 |
| 0.454159 | −0.627672 | 1.072200 |
| 0.456245 | −0.639661 | 1.072200 |
| 0.456210 | −0.647967 | 1.072200 |
| 0.453657 | −0.654132 | 1.072200 |
| 0.450539 | −0.658085 | 1.072200 |
| 0.447984 | −0.660255 | 1.072200 |
| 0.445126 | −0.662006 | 1.072200 |
| 0.443603 | −0.662703 | 1.072200 |
| 0.442032 | −0.663284 | 1.072200 |

TABLE 1-continued

| | | |
|---|---|---|
| 0.440785 | −0.663648 | 1.072200 |
| 0.439517 | −0.663933 | 1.072200 |
| 0.436952 | −0.664271 | 1.072200 |
| 0.434394 | −0.664315 | 1.072200 |
| 0.430595 | −0.663791 | 1.072200 |
| 0.425622 | −0.662020 | 1.072200 |
| 0.420337 | −0.658180 | 1.072200 |
| 0.415204 | −0.650927 | 1.072200 |
| 0.409447 | −0.640202 | 1.072200 |
| 0.402572 | −0.626865 | 1.072200 |
| 0.394642 | −0.611173 | 1.072200 |
| 0.385770 | −0.592877 | 1.072200 |
| 0.375943 | −0.572019 | 1.072200 |
| 0.365114 | −0.548608 | 1.072200 |
| 0.353127 | −0.522734 | 1.072200 |
| 0.339717 | −0.494532 | 1.072200 |
| 0.324846 | −0.464039 | 1.072200 |
| 0.309234 | −0.432408 | 1.072200 |
| 0.292455 | −0.398328 | 1.072200 |
| 0.275230 | −0.362944 | 1.072200 |
| 0.258018 | −0.327537 | 1.072200 |
| 0.240105 | −0.290962 | 1.072200 |
| 0.222104 | −0.254428 | 1.072200 |
| 0.204201 | −0.217843 | 1.072200 |
| 0.186390 | −0.181187 | 1.072200 |
| 0.168217 | −0.144693 | 1.072200 |
| 0.149442 | −0.108499 | 1.072200 |
| 0.129906 | −0.072698 | 1.072200 |
| 0.109532 | −0.037361 | 1.072200 |
| 0.088220 | −0.002567 | 1.072200 |
| 0.065857 | 0.031574 | 1.072200 |
| 0.042308 | 0.064920 | 1.072200 |
| 0.017412 | 0.097292 | 1.072200 |
| −0.009023 | 0.128429 | 1.072200 |
| −0.037226 | 0.157998 | 1.072200 |
| −0.066400 | 0.184652 | 1.072200 |
| −0.097687 | 0.208813 | 1.072200 |
| −0.130074 | 0.229048 | 1.072200 |
| −0.162098 | 0.244313 | 1.072200 |
| −0.194508 | 0.255004 | 1.072200 |
| −0.225380 | 0.260786 | 1.072200 |
| −0.254012 | 0.262347 | 1.072200 |
| −0.279914 | 0.260639 | 1.072200 |
| −0.302727 | 0.256856 | 1.072200 |
| −0.322905 | 0.254963 | 1.072200 |
| −0.340397 | 0.255932 | 1.072200 |
| −0.354861 | 0.259056 | 1.072200 |
| −0.366122 | 0.263448 | 1.072200 |
| −0.374257 | 0.268130 | 1.072200 |
| −0.379590 | 0.272177 | 1.072200 |
| −0.383502 | 0.275838 | 1.072200 |
| −0.386195 | 0.278818 | 1.072200 |
| −0.387868 | 0.280908 | 1.072200 |
| −0.389431 | 0.283080 | 1.072200 |
| −0.390173 | 0.284191 | 1.072200 |

SECTION NUMBER: 8
SECTION TITLE: H-H
SECTION COORDINATES (X, Y, R)

| | | |
|---|---|---|
| −0.378463 | 0.336573 | 1.250901 |
| −0.379132 | 0.338123 | 1.250901 |
| −0.379749 | 0.339689 | 1.250901 |
| −0.380829 | 0.342880 | 1.250901 |
| −0.381706 | 0.346137 | 1.250901 |
| −0.382637 | 0.351110 | 1.250901 |
| −0.383183 | 0.357846 | 1.250901 |
| −0.382805 | 0.366300 | 1.250901 |
| −0.380513 | 0.377950 | 1.250901 |
| −0.375077 | 0.392259 | 1.250901 |
| −0.365523 | 0.408369 | 1.250901 |
| −0.351209 | 0.425322 | 1.250901 |
| −0.332519 | 0.442957 | 1.250901 |
| −0.310009 | 0.461548 | 1.250901 |
| −0.283055 | 0.479976 | 1.250901 |
| −0.250978 | 0.496472 | 1.250901 |
| −0.213479 | 0.508461 | 1.250901 |
| −0.171149 | 0.512895 | 1.250901 |
| −0.127394 | 0.507675 | 1.250901 |
| −0.082619 | 0.492185 | 1.250901 |

TABLE 1-continued

| | | |
|---|---|---|
| −0.039975 | 0.467839 | 1.250901 |
| −0.001283 | 0.437514 | 1.250901 |
| 0.034999 | 0.401776 | 1.250901 |
| 0.068027 | 0.362935 | 1.250901 |
| 0.098324 | 0.321864 | 1.250901 |
| 0.126324 | 0.279134 | 1.250901 |
| 0.152367 | 0.235134 | 1.250901 |
| 0.176728 | 0.190132 | 1.250901 |
| 0.199617 | 0.144329 | 1.250901 |
| 0.221211 | 0.097864 | 1.250901 |
| 0.241649 | 0.050850 | 1.250901 |
| 0.261043 | 0.003374 | 1.250901 |
| 0.279491 | −0.044494 | 1.250901 |
| 0.297073 | −0.092699 | 1.250901 |
| 0.313862 | −0.141192 | 1.250901 |
| 0.329910 | −0.189932 | 1.250901 |
| 0.344777 | −0.237250 | 1.250901 |
| 0.359052 | −0.284737 | 1.250901 |
| 0.372309 | −0.330724 | 1.250901 |
| 0.384182 | −0.373532 | 1.250901 |
| 0.395226 | −0.414774 | 1.250901 |
| 0.405080 | −0.452774 | 1.250901 |
| 0.413833 | −0.487515 | 1.250901 |
| 0.421561 | −0.518978 | 1.250901 |
| 0.428330 | −0.547145 | 1.250901 |
| 0.434191 | −0.572015 | 1.250901 |
| 0.439184 | −0.593570 | 1.250901 |
| 0.443348 | −0.611847 | 1.250901 |
| 0.446855 | −0.626686 | 1.250901 |
| 0.447476 | −0.638296 | 1.250901 |
| 0.445200 | −0.646104 | 1.250901 |
| 0.441616 | −0.651609 | 1.250901 |
| 0.438093 | −0.655061 | 1.250901 |
| 0.435414 | −0.656968 | 1.250901 |
| 0.432520 | −0.658528 | 1.250901 |
| 0.431005 | −0.659169 | 1.250901 |
| 0.429456 | −0.659715 | 1.250901 |
| 0.428187 | −0.660086 | 1.250901 |
| 0.426900 | −0.660392 | 1.250901 |
| 0.424290 | −0.660806 | 1.250901 |
| 0.421665 | −0.660962 | 1.250901 |
| 0.417725 | −0.660701 | 1.250901 |
| 0.412574 | −0.659441 | 1.250901 |
| 0.406682 | −0.656450 | 1.250901 |
| 0.400117 | −0.650104 | 1.250901 |
| 0.394541 | −0.639354 | 1.250901 |
| 0.388216 | −0.625671 | 1.250901 |
| 0.380800 | −0.609546 | 1.250901 |
| 0.372320 | −0.590878 | 1.250901 |
| 0.362772 | −0.569691 | 1.250901 |
| 0.352141 | −0.545982 | 1.250901 |
| 0.340382 | −0.519781 | 1.250901 |
| 0.327412 | −0.491125 | 1.250901 |
| 0.313224 | −0.460023 | 1.250901 |
| 0.298417 | −0.427703 | 1.250901 |
| 0.282471 | −0.392895 | 1.250901 |
| 0.265988 | −0.356820 | 1.250901 |
| 0.249502 | −0.320740 | 1.250901 |
| 0.232408 | −0.283429 | 1.250901 |
| 0.215276 | −0.246132 | 1.250901 |
| 0.198145 | −0.208829 | 1.250901 |
| 0.181041 | −0.171499 | 1.250901 |
| 0.163878 | −0.134185 | 1.250901 |
| 0.146271 | −0.097062 | 1.250901 |
| 0.127889 | −0.060303 | 1.250901 |
| 0.108644 | −0.023979 | 1.250901 |
| 0.088440 | 0.011834 | 1.250901 |
| 0.067159 | 0.047032 | 1.250901 |
| 0.044663 | 0.081478 | 1.250901 |
| 0.020790 | 0.115003 | 1.250901 |
| −0.004653 | 0.147367 | 1.250901 |
| −0.031888 | 0.178260 | 1.250901 |
| −0.060143 | 0.206329 | 1.250901 |
| −0.090519 | 0.232112 | 1.250901 |
| −0.122028 | 0.254206 | 1.250901 |
| −0.153262 | 0.271598 | 1.250901 |
| −0.184993 | 0.284838 | 1.250901 |
| −0.215419 | 0.293509 | 1.250901 |
| −0.243917 | 0.298200 | 1.250901 |

TABLE 1-continued

| | | |
|---|---|---|
| −0.270013 | 0.299702 | 1.250901 |
| −0.293322 | 0.298875 | 1.250901 |
| −0.313760 | 0.298904 | 1.250901 |
| −0.331202 | 0.301607 | 1.250901 |
| −0.345390 | 0.306211 | 1.250901 |
| −0.356216 | 0.311803 | 1.250901 |
| −0.363859 | 0.317382 | 1.250901 |
| −0.368746 | 0.322046 | 1.250901 |
| −0.372236 | 0.326169 | 1.250901 |
| −0.374577 | 0.329474 | 1.250901 |
| −0.375993 | 0.331772 | 1.250901 |
| −0.377291 | 0.334141 | 1.250901 |
| −0.377893 | 0.335348 | 1.250901 |
| SECTION NUMBER: 9 | | |
| SECTION TITLE: J-J | | |
| SECTION COORDINATES (X, Y, R) | | |
| −0.365192 | 0.392633 | 1.429600 |
| −0.365609 | 0.394220 | 1.429600 |
| −0.365976 | 0.395820 | 1.429600 |
| −0.366558 | 0.399051 | 1.429600 |
| −0.366939 | 0.402314 | 1.429600 |
| −0.367135 | 0.407242 | 1.429600 |
| −0.366723 | 0.413811 | 1.429600 |
| −0.365195 | 0.421913 | 1.429600 |
| −0.361394 | 0.432829 | 1.429600 |
| −0.354201 | 0.445873 | 1.429600 |
| −0.342772 | 0.460066 | 1.429600 |
| −0.326617 | 0.474349 | 1.429600 |
| −0.305874 | 0.488096 | 1.429600 |
| −0.280787 | 0.500742 | 1.429600 |
| −0.251249 | 0.510837 | 1.429600 |
| −0.217411 | 0.516832 | 1.429600 |
| −0.179769 | 0.517151 | 1.429600 |
| −0.139255 | 0.510365 | 1.429600 |
| −0.098739 | 0.496267 | 1.429600 |
| −0.057825 | 0.474617 | 1.429600 |
| −0.018710 | 0.446891 | 1.429600 |
| 0.017234 | 0.415182 | 1.429600 |
| 0.051384 | 0.379225 | 1.429600 |
| 0.082741 | 0.340789 | 1.429600 |
| 0.111577 | 0.300397 | 1.429600 |
| 0.138169 | 0.258452 | 1.429600 |
| 0.162791 | 0.215283 | 1.429600 |
| 0.185687 | 0.171137 | 1.429600 |
| 0.207080 | 0.126214 | 1.429600 |
| 0.227161 | 0.080660 | 1.429600 |
| 0.246095 | 0.034595 | 1.429600 |
| 0.264023 | −0.011887 | 1.429600 |
| 0.281061 | −0.058715 | 1.429600 |
| 0.297312 | −0.105832 | 1.429600 |
| 0.312857 | −0.153190 | 1.429600 |
| 0.327766 | −0.200748 | 1.429600 |
| 0.341639 | −0.246882 | 1.429600 |
| 0.355027 | −0.293146 | 1.429600 |
| 0.367532 | −0.337921 | 1.429600 |
| 0.378805 | −0.379574 | 1.429600 |
| 0.389360 | −0.419683 | 1.429600 |
| 0.398841 | −0.456624 | 1.429600 |
| 0.407318 | −0.490384 | 1.429600 |
| 0.414849 | −0.520945 | 1.429600 |
| 0.421483 | −0.548300 | 1.429600 |
| 0.427256 | −0.572447 | 1.429600 |
| 0.432201 | −0.593377 | 1.429600 |
| 0.436385 | −0.611090 | 1.429600 |
| 0.438902 | −0.625554 | 1.429600 |
| 0.437299 | −0.636608 | 1.429600 |
| 0.433576 | −0.643762 | 1.429600 |
| 0.429410 | −0.648658 | 1.429600 |
| 0.425681 | −0.651708 | 1.429600 |
| 0.422956 | −0.653411 | 1.429600 |
| 0.420069 | −0.654825 | 1.429600 |
| 0.418575 | −0.655418 | 1.429600 |
| 0.417054 | −0.655936 | 1.429600 |
| 0.415764 | −0.656310 | 1.429600 |
| 0.414459 | −0.656626 | 1.429600 |
| 0.411813 | −0.657092 | 1.429600 |
| 0.409135 | −0.657326 | 1.429600 |
| 0.405103 | −0.657248 | 1.429600 |

TABLE 1-continued

| | | |
|---|---|---|
| 0.399833 | −0.656346 | 1.429600 |
| 0.393576 | −0.653974 | 1.429600 |
| 0.385951 | −0.648493 | 1.429600 |
| 0.379295 | −0.638451 | 1.429600 |
| 0.373502 | −0.624508 | 1.429600 |
| 0.366551 | −0.607935 | 1.429600 |
| 0.358403 | −0.588911 | 1.429600 |
| 0.349079 | −0.567385 | 1.429600 |
| 0.338610 | −0.543354 | 1.429600 |
| 0.327032 | −0.516799 | 1.429600 |
| 0.314452 | −0.487669 | 1.429600 |
| 0.300816 | −0.455979 | 1.429600 |
| 0.286640 | −0.423017 | 1.429600 |
| 0.271356 | −0.387520 | 1.429600 |
| 0.255491 | −0.350772 | 1.429600 |
| 0.239611 | −0.314025 | 1.429600 |
| 0.223185 | −0.276006 | 1.429600 |
| 0.206754 | −0.237981 | 1.429600 |
| 0.190397 | −0.199924 | 1.429600 |
| 0.174013 | −0.161870 | 1.429600 |
| 0.157525 | −0.123845 | 1.429600 |
| 0.140586 | −0.085998 | 1.429600 |
| 0.122895 | −0.048480 | 1.429600 |
| 0.104361 | −0.011364 | 1.429600 |
| 0.084887 | 0.025283 | 1.429600 |
| 0.064363 | 0.061367 | 1.429600 |
| 0.042655 | 0.096768 | 1.429600 |
| 0.019616 | 0.131331 | 1.429600 |
| −0.004939 | 0.164852 | 1.429600 |
| −0.031206 | 0.197066 | 1.429600 |
| −0.058438 | 0.226630 | 1.429600 |
| −0.087684 | 0.254222 | 1.429600 |
| −0.118003 | 0.278482 | 1.429600 |
| −0.148068 | 0.298398 | 1.429600 |
| −0.178690 | 0.314671 | 1.429600 |
| −0.208220 | 0.326751 | 1.429600 |
| −0.236130 | 0.335104 | 1.429600 |
| −0.261975 | 0.340340 | 1.429600 |
| −0.285381 | 0.343120 | 1.429600 |
| −0.305858 | 0.345840 | 1.429600 |
| −0.322955 | 0.350889 | 1.429600 |
| −0.336526 | 0.357454 | 1.429600 |
| −0.346574 | 0.364575 | 1.429600 |
| −0.353421 | 0.371261 | 1.429600 |
| −0.357634 | 0.376643 | 1.429600 |
| −0.360518 | 0.381283 | 1.429600 |
| −0.362370 | 0.384939 | 1.429600 |
| −0.363443 | 0.387453 | 1.429600 |
| −0.364385 | 0.390021 | 1.429600 |
| −0.364806 | 0.391321 | 1.429600 |

SECTION NUMBER: 10
SECTION TITLE: K-K
SECTION COORDINATES (X, Y, R)

| | | |
|---|---|---|
| −0.350395 | 0.452377 | 1.608300 |
| −0.350527 | 0.453974 | 1.608300 |
| −0.350608 | 0.455577 | 1.608300 |
| −0.350625 | 0.458790 | 1.608300 |
| −0.350449 | 0.461994 | 1.608300 |
| −0.349828 | 0.466774 | 1.608300 |
| −0.348364 | 0.473034 | 1.608300 |
| −0.345596 | 0.480590 | 1.608300 |
| −0.340208 | 0.490498 | 1.608300 |
| −0.331222 | 0.501908 | 1.608300 |
| −0.317965 | 0.513727 | 1.608300 |
| −0.300133 | 0.524813 | 1.608300 |
| −0.277676 | 0.533904 | 1.608300 |
| −0.250728 | 0.539452 | 1.608300 |
| −0.219873 | 0.540062 | 1.608300 |
| −0.186058 | 0.534910 | 1.608300 |
| −0.150284 | 0.523834 | 1.608300 |
| −0.113316 | 0.507133 | 1.608300 |
| −0.076966 | 0.486030 | 1.608300 |
| −0.039998 | 0.460024 | 1.608300 |
| −0.003960 | 0.430151 | 1.608300 |
| 0.029846 | 0.397724 | 1.608300 |
| 0.062492 | 0.361862 | 1.608300 |
| 0.092777 | 0.323947 | 1.608300 |
| 0.120740 | 0.284257 | 1.608300 |

TABLE 1-continued

| | | |
|---|---|---|
| 0.146508 | 0.243075 | 1.608300 |
| 0.170280 | 0.200679 | 1.608300 |
| 0.192266 | 0.157314 | 1.608300 |
| 0.212689 | 0.113166 | 1.608300 |
| 0.231750 | 0.068395 | 1.608300 |
| 0.249630 | 0.023123 | 1.608300 |
| 0.266494 | −0.022544 | 1.608300 |
| 0.282473 | −0.068536 | 1.608300 |
| 0.297690 | −0.114790 | 1.608300 |
| 0.312242 | −0.161259 | 1.608300 |
| 0.326212 | −0.207898 | 1.608300 |
| 0.339234 | −0.253122 | 1.608300 |
| 0.351835 | −0.298451 | 1.608300 |
| 0.363645 | −0.342302 | 1.608300 |
| 0.374336 | −0.383083 | 1.608300 |
| 0.384384 | −0.422340 | 1.608300 |
| 0.393450 | −0.458489 | 1.608300 |
| 0.401588 | −0.491515 | 1.608300 |
| 0.408845 | −0.521408 | 1.608300 |
| 0.415257 | −0.548166 | 1.608300 |
| 0.420856 | −0.571779 | 1.608300 |
| 0.425667 | −0.592261 | 1.608300 |
| 0.429593 | −0.609538 | 1.608300 |
| 0.430109 | −0.623738 | 1.608300 |
| 0.426406 | −0.634154 | 1.608300 |
| 0.422005 | −0.640671 | 1.608300 |
| 0.417508 | −0.645094 | 1.608300 |
| 0.413667 | −0.647861 | 1.608300 |
| 0.410921 | −0.649417 | 1.608300 |
| 0.408049 | −0.650728 | 1.608300 |
| 0.406573 | −0.651285 | 1.608300 |
| 0.405073 | −0.651781 | 1.608300 |
| 0.403762 | −0.652156 | 1.608300 |
| 0.402437 | −0.652477 | 1.608300 |
| 0.399756 | −0.652978 | 1.608300 |
| 0.397047 | −0.653275 | 1.608300 |
| 0.392962 | −0.653334 | 1.608300 |
| 0.387540 | −0.652693 | 1.608300 |
| 0.381010 | −0.650753 | 1.608300 |
| 0.372740 | −0.646067 | 1.608300 |
| 0.364312 | −0.637157 | 1.608300 |
| 0.358258 | −0.623284 | 1.608300 |
| 0.351556 | −0.606368 | 1.608300 |
| 0.343646 | −0.586972 | 1.608300 |
| 0.334570 | −0.565021 | 1.608300 |
| 0.324372 | −0.540523 | 1.608300 |
| 0.313106 | −0.513444 | 1.608300 |
| 0.300901 | −0.483734 | 1.608300 |
| 0.287621 | −0.451442 | 1.608300 |
| 0.273794 | −0.417867 | 1.608300 |
| 0.258893 | −0.381710 | 1.608300 |
| 0.243457 | −0.344263 | 1.608300 |
| 0.228010 | −0.306812 | 1.608300 |
| 0.212017 | −0.268075 | 1.608300 |
| 0.196005 | −0.229341 | 1.608300 |
| 0.180201 | −0.190518 | 1.608300 |
| 0.164404 | −0.151675 | 1.608300 |
| 0.148350 | −0.112926 | 1.608300 |
| 0.131829 | −0.074361 | 1.608300 |
| 0.114609 | −0.036085 | 1.608300 |
| 0.096568 | 0.001820 | 1.608300 |
| 0.077620 | 0.039298 | 1.608300 |
| 0.057663 | 0.076262 | 1.608300 |
| 0.036573 | 0.112610 | 1.608300 |
| 0.014217 | 0.148214 | 1.608300 |
| −0.009567 | 0.182899 | 1.608300 |
| −0.034951 | 0.216453 | 1.608300 |
| −0.061192 | 0.247551 | 1.608300 |
| −0.089287 | 0.277005 | 1.608300 |
| −0.118325 | 0.303516 | 1.608300 |
| −0.147056 | 0.326058 | 1.608300 |
| −0.176313 | 0.345492 | 1.608300 |
| −0.204579 | 0.361143 | 1.608300 |
| −0.231418 | 0.373374 | 1.608300 |
| −0.256429 | 0.382650 | 1.608300 |
| −0.279270 | 0.389474 | 1.608300 |
| −0.299257 | 0.395573 | 1.608300 |
| −0.315483 | 0.403443 | 1.608300 |
| −0.327917 | 0.412293 | 1.608300 |

TABLE 1-continued

| | | |
|---|---|---|
| −0.336725 | 0.421124 | 1.608300 |
| −0.342403 | 0.428987 | 1.608300 |
| −0.345667 | 0.435091 | 1.608300 |
| −0.347733 | 0.440229 | 1.608300 |
| −0.348938 | 0.444203 | 1.608300 |
| −0.349568 | 0.446901 | 1.608300 |
| −0.350054 | 0.449625 | 1.608300 |
| −0.350243 | 0.451000 | 1.608300 |
| SECTION NUMBER: 11 | | |
| SECTION TITLE: L-L | | |
| SECTION COORDINATES (X, Y, R) | | |
| −0.334014 | 0.515452 | 1.787000 |
| −0.333815 | 0.517033 | 1.787000 |
| −0.333563 | 0.518606 | 1.787000 |
| −0.332922 | 0.521727 | 1.787000 |
| −0.332094 | 0.524807 | 1.787000 |
| −0.330519 | 0.529321 | 1.787000 |
| −0.327826 | 0.535102 | 1.787000 |
| −0.323610 | 0.541876 | 1.787000 |
| −0.316386 | 0.550407 | 1.787000 |
| −0.305371 | 0.559653 | 1.787000 |
| −0.290128 | 0.568422 | 1.787000 |
| −0.270604 | 0.575516 | 1.787000 |
| −0.247006 | 0.579428 | 1.787000 |
| −0.219962 | 0.578391 | 1.787000 |
| −0.190424 | 0.571909 | 1.787000 |
| −0.159165 | 0.560037 | 1.787000 |
| −0.126703 | 0.542966 | 1.787000 |
| −0.093398 | 0.520896 | 1.787000 |
| −0.060779 | 0.495024 | 1.787000 |
| −0.027747 | 0.464636 | 1.787000 |
| 0.004382 | 0.431006 | 1.787000 |
| 0.034560 | 0.395603 | 1.787000 |
| 0.063850 | 0.357423 | 1.787000 |
| 0.091295 | 0.317890 | 1.787000 |
| 0.117014 | 0.277211 | 1.787000 |
| 0.141134 | 0.235557 | 1.787000 |
| 0.163785 | 0.193085 | 1.787000 |
| 0.185089 | 0.149917 | 1.787000 |
| 0.205168 | 0.106164 | 1.787000 |
| 0.224135 | 0.061919 | 1.787000 |
| 0.242100 | 0.017252 | 1.787000 |
| 0.259157 | −0.027767 | 1.787000 |
| 0.275397 | −0.073087 | 1.787000 |
| 0.290894 | −0.118665 | 1.787000 |
| 0.305726 | −0.164460 | 1.787000 |
| 0.319947 | −0.210444 | 1.787000 |
| 0.333171 | −0.255047 | 1.787000 |
| 0.345920 | −0.299783 | 1.787000 |
| 0.357818 | −0.343082 | 1.787000 |
| 0.368530 | −0.383370 | 1.787000 |
| 0.378542 | −0.422178 | 1.787000 |
| 0.387522 | −0.457933 | 1.787000 |
| 0.395535 | −0.490617 | 1.787000 |
| 0.402636 | −0.520217 | 1.787000 |
| 0.408878 | −0.546727 | 1.787000 |
| 0.414298 | −0.570121 | 1.787000 |
| 0.418935 | −0.590444 | 1.787000 |
| 0.422082 | −0.607566 | 1.787000 |
| 0.419964 | −0.621489 | 1.787000 |
| 0.415190 | −0.631331 | 1.787000 |
| 0.410229 | −0.637398 | 1.787000 |
| 0.405489 | −0.641499 | 1.787000 |
| 0.401549 | −0.644074 | 1.787000 |
| 0.398773 | −0.645530 | 1.787000 |
| 0.395894 | −0.646773 | 1.787000 |
| 0.394423 | −0.647309 | 1.787000 |
| 0.392927 | −0.647789 | 1.787000 |
| 0.391588 | −0.648167 | 1.787000 |
| 0.390238 | −0.648500 | 1.787000 |
| 0.387503 | −0.649026 | 1.787000 |
| 0.384742 | −0.649366 | 1.787000 |
| 0.380570 | −0.649523 | 1.787000 |
| 0.375027 | −0.649067 | 1.787000 |
| 0.368274 | −0.647451 | 1.787000 |
| 0.359478 | −0.643309 | 1.787000 |
| 0.350095 | −0.635143 | 1.787000 |
| 0.342522 | −0.621789 | 1.787000 |

TABLE 1-continued

| | | |
|---|---|---|
| 0.335954 | −0.604585 | 1.787000 |
| 0.328203 | −0.584722 | 1.787000 |
| 0.319263 | −0.562299 | 1.787000 |
| 0.309159 | −0.537285 | 1.787000 |
| 0.298063 | −0.509619 | 1.787000 |
| 0.286022 | −0.479270 | 1.787000 |
| 0.272928 | −0.446285 | 1.787000 |
| 0.259302 | −0.411984 | 1.787000 |
| 0.244619 | −0.375049 | 1.787000 |
| 0.229397 | −0.336800 | 1.787000 |
| 0.214166 | −0.298550 | 1.787000 |
| 0.198400 | −0.258984 | 1.787000 |
| 0.182622 | −0.219419 | 1.787000 |
| 0.166878 | −0.179833 | 1.787000 |
| 0.151131 | −0.140241 | 1.787000 |
| 0.135343 | −0.100655 | 1.787000 |
| 0.119355 | −0.061128 | 1.787000 |
| 0.102729 | −0.021845 | 1.787000 |
| 0.085278 | 0.017096 | 1.787000 |
| 0.066916 | 0.055631 | 1.787000 |
| 0.047545 | 0.093687 | 1.787000 |
| 0.027049 | 0.131171 | 1.787000 |
| 0.005298 | 0.167966 | 1.787000 |
| −0.017843 | 0.203921 | 1.787000 |
| −0.042534 | 0.238856 | 1.787000 |
| −0.068017 | 0.271446 | 1.787000 |
| −0.095224 | 0.302638 | 1.787000 |
| −0.123222 | 0.331168 | 1.787000 |
| −0.150780 | 0.356048 | 1.787000 |
| −0.178674 | 0.378330 | 1.787000 |
| −0.205477 | 0.397310 | 1.787000 |
| −0.230812 | 0.413346 | 1.787000 |
| −0.254353 | 0.426823 | 1.787000 |
| −0.275834 | 0.438109 | 1.787000 |
| −0.294561 | 0.448265 | 1.787000 |
| −0.309205 | 0.459391 | 1.787000 |
| −0.319847 | 0.470761 | 1.787000 |
| −0.326854 | 0.481390 | 1.787000 |
| −0.330915 | 0.490419 | 1.787000 |
| −0.332916 | 0.497199 | 1.787000 |
| −0.333913 | 0.502762 | 1.787000 |
| −0.334282 | 0.506986 | 1.787000 |
| −0.334345 | 0.509811 | 1.787000 |
| −0.334254 | 0.512633 | 1.787000 |
| −0.334153 | 0.514046 | 1.787000 |

While the present invention has been described in the context of specific embodiments thereof, other alternatives, modifications and variations will become apparent to those skilled in the art having read the foregoing description. Accordingly, it is intended to embrace those alternatives, modifications and variations as fall within the broad scope of the appended claims.

What is claimed is:

1. An aerodynamic profile for an airfoil, comprising:

an uncoated, nominal shape formed by fairing a plurality of radial sections, said sections located within an envelope of ±0.006 inches in any direction perpendicular to an airfoil stacking line extending radially from a central axis and defined by X, Y, and R Cartesian coordinate values in inches as listed in Table 1; and wherein R is a perpendicular distance from a plane normal to the airfoil stacking line with R values of zero at a lowermost radial section and increasing in the radial direction and the X and Y values are perpendicular distances from the airfoil stacking line.

2. The aerodynamic profile of claim 1:

wherein each of said X, Y, and R coordinates are scaled by a positive value.

3. A gas turbine blade comprising:

an airfoil profile, said profile having a nominal and uncoated shape formed by fairing a plurality of radial sections, said sections located within an envelope of ±0.006 inches in any direction perpendicular to an airfoil stacking line extending radially from a central axis and defined by X, Y, and R Cartesian coordinate values in inches as listed in Table 1; and wherein R is a perpendicular distance from a plane normal to the airfoil stacking line with R values of zero at a lowermost radial section and increasing in the radial direction and the X and Y values are perpendicular distances from the airfoil stacking line.

4. The gas turbine blade of claim 3: wherein said blade is a first stage turbine blade.

5. An aerodynamic profile for an airfoil, comprising:

a nominal and uncoated shape formed by fairing a plurality of radial sections, said sections located within an envelope of ±0.006 inches in any direction perpendicular to an airfoil stacking line extending radially from a central axis and defined by X, Y, and R Cartesian coordinate values in inches as listed in Table 1, wherein R is a perpendicular distance from a plane normal to the airfoil stacking line with R values of zero at a lowermost radial section and increasing in the radial direction and the X and Y values are perpendicular distances from the airfoil stacking line;

a coating, said coating being applied over the nominal and uncoated shape; and wherein said coating has a thickness of between +0.002 and +0.014 inches.

6. The aerodynamic profile of claim 5:

wherein each of said X, Y, and R coordinates are scaled by a positive value.

7. A turbine blade comprising:

A coated airfoil profile, said profile having a shape formed by fairing a plurality of radial sections, said sections located within an envelope of between −0.004 and +0.020 inches in any direction perpendicular to an airfoil stacking line, said stacking line extending radially from a central axis and defined by X, Y, and R Cartesian coordinate values in inches as listed in Table 1; and wherein R is a perpendicular distance from a plane normal to the airfoil stacking line with R values of zero at a lowermost radial section and increasing in the radial direction and the X and Y values are perpendicular distances from the airfoil stacking line.

8. The gas turbine blade of claim 7: wherein said blade is a first stage turbine blade.

* * * * *